US009102338B2

(12) United States Patent
Fanara

(10) Patent No.: US 9,102,338 B2
(45) Date of Patent: Aug. 11, 2015

(54) ONBOARD COMMUNICATION SYSTEM FOR A LOCOMOTIVE CONSIST

(71) Applicant: Electro-Motive Diesel, Inc., LaGrange, IL (US)

(72) Inventor: Mark Alan Fanara, Blue Springs, MO (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 103 days.

(21) Appl. No.: 13/768,153

(22) Filed: Feb. 15, 2013

(65) Prior Publication Data

US 2014/0231595 A1 Aug. 21, 2014

(51) Int. Cl.
*B61L 15/00* (2006.01)
*B61C 17/12* (2006.01)

(52) U.S. Cl.
CPC ..... *B61C 17/12* (2013.01); *B61L 15/0027* (2013.01); *B61L 15/0081* (2013.01)

(58) Field of Classification Search
USPC ..... 701/29.1, 19, 20; 455/67.11
See application file for complete search history.

(56) References Cited

U.S. PATENT DOCUMENTS

| | | | | |
|---|---|---|---|---|
| 7,091,822 | B2 * | 8/2006 | Flick et al. | 340/5.72 |
| 7,765,859 | B2 | 8/2010 | Connell et al. | |
| 2005/0148306 | A1 * | 7/2005 | Hiddink | 455/101 |
| 2005/0160169 | A1 | 7/2005 | Segal et al. | |
| 2006/0085103 | A1 * | 4/2006 | Smith et al. | 701/19 |
| 2007/0282494 | A1 | 12/2007 | Moffitt et al. | |
| 2010/0004805 | A1 | 1/2010 | Denis et al. | |
| 2010/0204856 | A1 * | 8/2010 | Smith et al. | 701/19 |
| 2011/0319029 | A1 * | 12/2011 | Caudill et al. | 455/67.11 |
| 2012/0123617 | A1 | 5/2012 | Noffsinger et al. | |
| 2012/0136515 | A1 * | 5/2012 | Noffsinger et al. | 701/19 |

FOREIGN PATENT DOCUMENTS

| | | |
|---|---|---|
| EP | 0 794 632 A2 | 9/1997 |
| JP | 08002416 | 1/1996 |
| WO | 2012074680 | 6/2012 |

* cited by examiner

*Primary Examiner* — John R Olszewski
*Assistant Examiner* — James M McPherson
(74) *Attorney, Agent, or Firm* — Finnegan, Henderson, Farabow, Garrett & Dunner, LLP

(57) ABSTRACT

An onboard communication system for a locomotive consist is disclosed. The communication system may have first and second locomotive communication subsystems. The first communication subsystem may be located on a first locomotive. Each communication subsystem may have a messaging unit communicatively connected to a radio. The first messaging unit may be communicatively connected to the second messaging unit. The second messaging unit may be configured to receive a data communication from the second radio and send the data communication to the first messaging unit. The first messaging unit may be configured to receive the data communication from the second messaging unit, receive a copy of the data communication from the first radio, determine that the data communications are duplicate copies of one another, and send one of the data communications to a locomotive control system based on the determination.

19 Claims, 3 Drawing Sheets

ONBOARD COMMUNICATION SYSTEM FOR A LOCOMOTIVE CONSIST

TECHNICAL FIELD

The present disclosure is directed to a locomotive consist and, more particularly, to an onboard communication system for a locomotive consist.

BACKGROUND

As safety concerns for rail systems become an increasingly important public issue, a need has arisen for implementing an automated control system, such as positive train control (PTC), which incorporates automated systems and processes for controlling a train. The systems include onboard equipment capable of data communication with offboard equipment. The onboard equipment generally includes a train management computer (TMC) configured to impart control over the train and communicate with the offboard equipment via a radio. The radio receives and forwards messages from offboard equipment to the TMC. The radio also receives and forwards messages from the TMC to the offboard equipment. In this way, automated remote management of a rail system may be possible.

While various wireless communication technologies may facilitate communication between the offboard equipment and onboard radio, the train's mobile and constantly changing environment may, at times, make wireless communications unreliable. If the wireless communication is not sufficiently reliable, the automated control system cannot be implemented efficiently. Further, significant reliance is placed on each radio to function properly. If a radio fails, the automated control system cannot be operated because of the risk of messages going undelivered. Further, possible solutions requiring modifications to currently-existing train components (e.g., TMC and/or radios) may be expensive and/or difficult to implement.

One system implementing PTC is described in U.S. Patent Application Publication 2012/0123617 to Noffsinger et al. ("the '617 publication"). The PTC system of the '617 publication includes computing systems on multiple rail vehicles that can communicate with each other through more than one pathway. The communication can occur through a wireless network provided by a wayside device. In particular, if a direct radio link between first and second rail vehicles is unavailable, a data communication can be sent between the first and second rail vehicles via the wireless network provided by the wayside device.

While the communication system described in the '617 publication may create new communication pathways, it may be subject to the same drawbacks associated with wireless communication, including unreliability and increased use of bandwidth. The system described in the '617 publication may increase reliance on radio communication, which remains problematic if the radio fails. Further, implementation of the described system may require modifications to existing computing systems and installation of new wayside equipment to allow for communication via the wayside wireless pathway, increasing costs and complexity.

Some offboard communication systems may address reliability by utilizing data forwarding between various wayside equipment modules. For example, some offboard equipment modules may be configured to share inbound and outbound communications with each other. While these wayside systems may address some offboard equipment concerns, they do not improve the reliability of onboard communication systems.

The present disclosure is directed to overcoming one or more of the problems set forth above and/or other problems of the prior art.

SUMMARY

In one aspect, the present disclosure is directed to an onboard communication system for a locomotive consist. The communication system may include a first locomotive communication subsystem located on a first locomotive, which may include a first radio and a first messaging unit communicatively connected to the first radio. The communication system may also include a second locomotive communication subsystem, which may include a second radio and a second messaging unit communicatively connected to the second radio and the first messaging unit. The second messaging unit may be configured to receive a data communication from the second radio, and send the data communication to the first messaging unit. The first messaging unit may be configured to receive the data communication from the second messaging unit, and receive a copy of the data communication from the first radio. The first messaging unit may be further configured to determine that the data communication and the copy of the data communication are duplicate copies of one another, and send one of the data communication or the copy of the data communication to an onboard locomotive control system based on the determination.

In another aspect, the present disclosure is directed to a method for managing data communication in a locomotive consist. The method may include receiving a data communication on a first radio on a first locomotive, and sending, by the first radio, the data communication to a first messaging unit on the first locomotive. The method may also include receiving a copy of the data communication on a second radio on a second locomotive and sending, by the second radio, the copy of the data communication to a second messaging unit on the second locomotive. The method may additionally include sending the copy of the data communication from the second messaging unit on the second locomotive to the first messaging unit on the first locomotive.

In another aspect, the present disclosure is directed to another method for managing data communication in a locomotive consist. The method may include receiving a data communication on a first messaging unit on a first locomotive. The method may also include sending health information from a first radio on the first locomotive and a second radio on a second locomotive to the first messaging unit, and determining from the health information which of the first radio and second radio is suitable for transmitting the data communication. The method may additionally include sending the data communication to one of the first radio and the second radio based on the determination, wherein sending the data communication to the second radio includes sending the data communication through a second messaging unit on the second locomotive.

DETAILED DESCRIPTION

Figure 1:
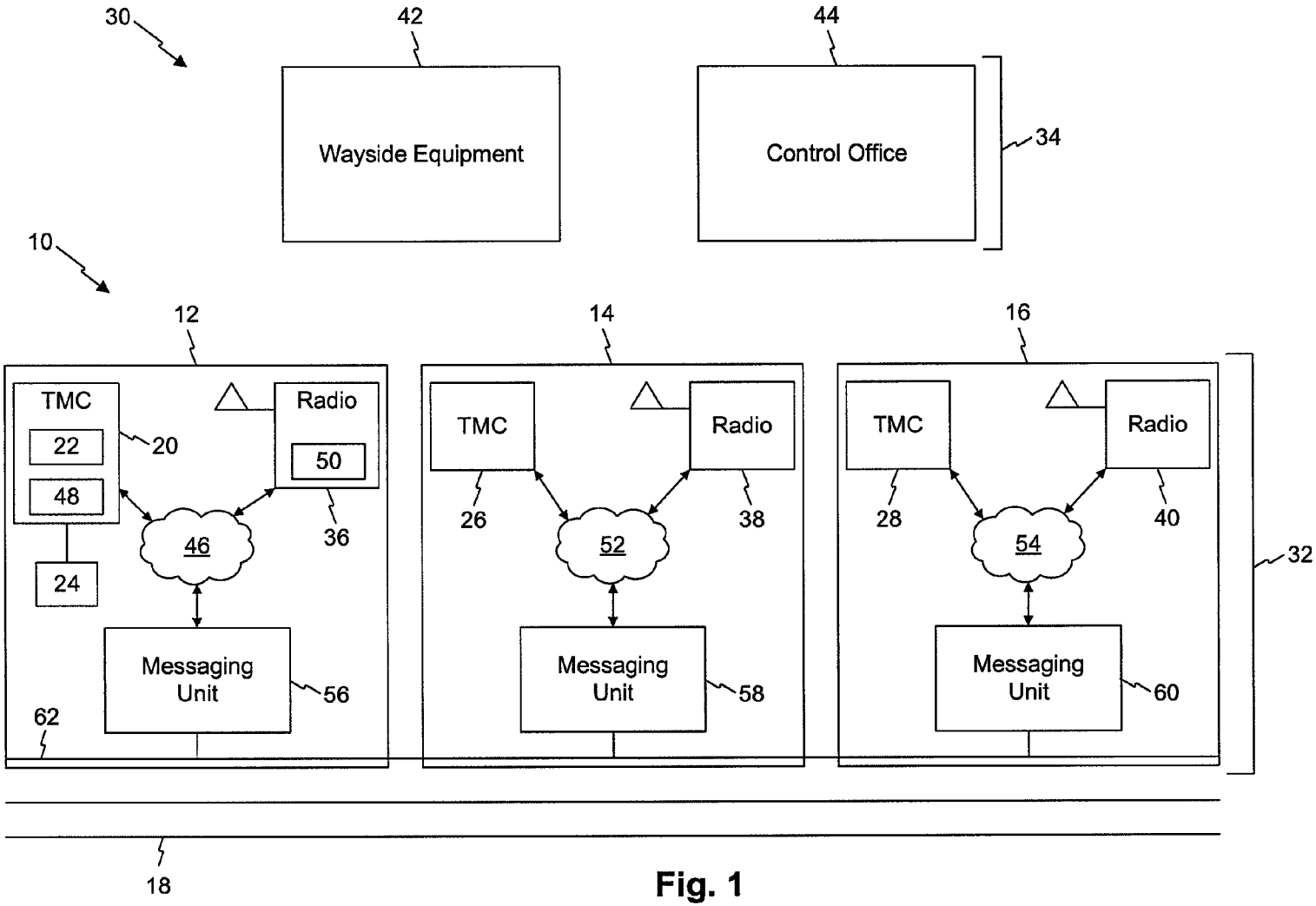
FIG. 1 depicts an exemplary locomotive consist including an exemplary embodiment of a communication system.

FIG. 1 schematically illustrates an exemplary communication system that may be implemented on a rail vehicle consist 10 (e.g., a train). Rail vehicle consist 10 may include a plurality of locomotives coupled to one another, such as locomotives 12, 14, and 16. Each of locomotives 12, 14, 16 may provide power to propel rail vehicle consist 10 along a track 18. For example, each locomotive 12, 14, 16 may include a diesel engine that provides power to traction devices located on rails of track 18. Rail vehicle consist 10 may also include one or more railcars, such as freight and/or passenger railcars (not shown) coupled to locomotive 12, 14 and/or 16. While three locomotives 12, 14, 16 are depicted, it is contemplated that rail vehicle consist 10 may include any number of locomotives and any number of railcars coupled to or between locomotives 12, 14, 16, depending on the particular requirements of rail vehicle consist 10.

Locomotive 12 may include one or more locomotive control systems configured to electronically control components of locomotive 12. In an exemplary embodiment, the locomotive control systems may be a train management computer (TMC) 20. TMC 20 may be configured to electronically control an engine powering locomotive 12 via a controller 22. For example, TMC 20 may receive inbound instructions to operate the engine at a particular speed for a selected amount of time and execute the instructions with controller 22. TMC 20 may also send and receive information (e.g., engine data, operation instructions, emergency messages, etc.) to and from a user display 24 for interaction with operators of train vehicle consist 10. In addition, TMC 20 may generate outbound data (e.g., engine speed or other performance parameters) to be sent to management equipment separate from TMC 20. TMC 20 may further include and/or communicate with a GPS device (not shown) that generates location information about rail vehicle consist 10 that may be useful for managing rail system traffic. Each locomotive 14, 16 may be similarly controlled by an associated TMC 26, 28, respectively. While TMCs 20, 26, 28 are described herein, other onboard locomotive control systems (e.g., emergency systems, infotainment systems, lighting systems, etc.) may be utilized with the disclosed communication system.

Controller 22 may include one or more computing devices such as a one or more microprocessors. For example, controller 22 may embody a general microprocessor capable of controlling numerous machine or engine functions. Controller 22 may also include all of the components required to run an application such as, for example, a computer-readable memory, a secondary storage device, and a processor, such as a central processing unit or any other means known. Various other known circuits may be associated with controller 22, including power source and other appropriate circuitry.

As further depicted in FIG. 1, rail vehicle consist 10 may include components of an automated control system 30. In one example, automated control system 30 may implement a PTC system or any other train control system. Automated control system 30 may represent an infrastructure control system configured to provide automated control of rail vehicles and rail vehicle consists within its range. For example, automated control system 30 may be arranged to monitor all rail traffic within a specified area and send and receive instructions to coordinate control of each rail vehicle consist within the area to help ensure safe and efficient rail vehicle navigation. In an exemplary embodiment, automated control system 30 may include onboard equipment 32 and offboard equipment 34. Onboard equipment 32 may include the components of each TMC 20, 26, 28, along with respectively-connected radios 36, 38, 40 for communicating the onboard equipment with the offboard equipment.

Offboard equipment 34 may include, for example, wayside equipment 42 and a control office 44. Wayside equipment 42 may represent various trackside mechanisms that coordinate and manage information pertinent to local rail vehicle operation. For example, wayside equipment 42 may include track switches, speed restriction signs, stop lights, and other traffic control devices. Control office 44 may include one or more remote systems configured to receive and provide data related to operation of automated control system 30.

Offboard equipment 34 of automated control system 30 may communicate with TMC 20 through an electronically-connected radio 36. Radio 36 may include a receiving device configured to receive data communications from wayside equipment 42 and/or control office 44 and relay the messages to TMC 20. Radio 36 may also include a transmission device configured to forward data communications from TMC 20 to wayside equipment 42 and/or control office 44. Receipt and transmission of data may occur through the same device, such as an antenna. In the exemplary disclosed embodiment, data communication within and between onboard equipment 32 and offboard equipment may include messages used to implement automated control system 30. Examples of messages to be relayed through radio 36 may include movement authorities, speed restrictions, operator instructions, etc. Radios 38, 40 may be connected to a respective TMC 26, 28 to similarly manage the communications of locomotives 14, 16.

In the exemplary disclosed automated control system 30, TMC 20 may be connected to communicate messages with radio 36 via a local network 46. Local network 46 may be "local" only to locomotive 12 (i.e., only equipment onboard locomotive 12 may connect to local network 46). Local network 46 may include one or more wired and/or wireless networks used to facilitate communications between an input/output device 48 of TMC 20 and an input/output device 50 of radio 36. In this manner, data sent between TMC 20 and radio 36 may be delivered through local network 46. For example, TMC 20 and radio 36 may utilize ITC standard EMP Class C and Class D messaging. Each locomotive 14, 16 may include a local network 52, 54 to which each TMC 26, 28 and radio 38, 40 are respectively connected. It should be understood that local networks 52, 54 may be arranged similarly to local network 46.

Locomotive 12 may also include a messaging unit 56 in communication with TMC 20 and radio 36. Messaging unit 56 may be connected as part of onboard equipment 32 to increase the likelihood of messages (e.g., messages sent to or from TMC 20) being delivered to their intended recipient. In certain embodiments, messaging unit 56 may include one or more electronic devices that is communicatively connected to TMC 20 and radio 36 via local network 46. Messaging unit 56 may include one or more components required to run an application such as, for example, a computer-readable memory, a secondary storage device, and a computer processor, such as a central processing unit or any other means known that may enable messaging unit 56 to perform operations consistent with the embodiments discussed herein. In other embodiments, messaging unit 56 may be a program or application installed on and configured to be run by the components of one of TMC 20 or radio 36 in order to perform operations consistent with the embodiments discussed herein. Messaging units 58, 60 may be similarly configured and arranged with respect to each TMC 26, 28 and radio 38, 40.

As depicted in FIG. 1, messaging units 56, 58, 60 may be electronically connected to each other via an intra-consist network 62. Intra-consist network 62 may be a wired (e.g., Ethernet) connection between input/output devices associated with each messaging unit 56, 58, 60. In other embodiments, intra-consist network 62 may be a wireless network to which each messaging unit 56, 58, 60 may connect. Messaging units 56, 58, 60 may communicate with each other through intra-consist network 62 to, for example, share data between locomotives 12, 14, 16. In this way, each TMC 20, 26, 28 and radio 36, 38, 40 may be communicatively connected to each other through a pathway created by one or more of messaging units 56, 58, 60 and intra-consist network 62.

In the exemplary disclosed embodiment, messaging unit 56, TMC 20, and radio 36 may be configured such that messaging unit 56 receives and/or interprets data sent from TMC 20 and radio 36. The manner in which messaging unit 56 acquires the data may depend on the particular connection and network arrangement of locomotive 12. In the exemplary disclosed arrangement depicted in FIG. 1, TMC 20 and radio 36 may send data to local network 46, to which messaging unit 56 may be connected. In one embodiment, messaging unit 56 may be configured to receive data that is intended for it. For example, TMC 20 and/or radio 36 may send data directly to the input/output device associated with messaging unit 56 over network 46. In another embodiment, TMC 20, radio 36, and messaging unit 56 may be configured such that messaging unit 56 intercepts data sent, via network 46, from one of TMC 20 and radio 36 and intended for the other of TMC 20 and radio 36. For example, messaging unit 56 may be configured to appear to TMC 20 as if it were radio 36. Similarly, messaging unit 56 may be configured to appear to radio 36 as if it were TMC 20. This may be accomplished, for example, by altering the IP address settings of TMC 20 and radio 36, or by utilizing electronic switches. In this way, messaging unit 56 may act as a gateway between TMC 20 and radio 36 without substantial modification to TMC 20 and radio 36. Messaging units 58, 60 may be similarly arranged with respect to TMCs 26, 28 and radios 38, 40.

The content of the data received by messaging units 56, 58, 60 may vary, depending on the desired function of messaging units 56, 58, 60. In one example, the data received by messaging unit 56 may include information related to the health of a particular piece of onboard equipment 32. For example, messaging unit 56 may be configured to monitor the status of radio 36 to determine if radio 36 is operating correctly with the ability to communicate with other equipment as necessary. The information may include health reports created and delivered by radio 36 and/or operation statistics maintained and evaluated by messaging unit 56. In another example, the data may include messages, such as those sent from TMC 20 to be delivered to offboard equipment 34 via radio 36 and those to be forwarded to TMC 20 after being received by radio 36 from offboard equipment 34. The messages may be intercepted by messaging unit 56 and evaluated before being sent along to TMC 20 or radio 36.

The exemplary disclosed arrangement of onboard equipment 32 may allow for diversity and efficiency of data functions within rail vehicle consist 10. In this way, automated control system 30 may include several processes that may serve as efficiency protocol that increase the probability that automated control system 30 will function properly, for which several exemplary processes are described below.

Industrial Applicability

Figure 2:
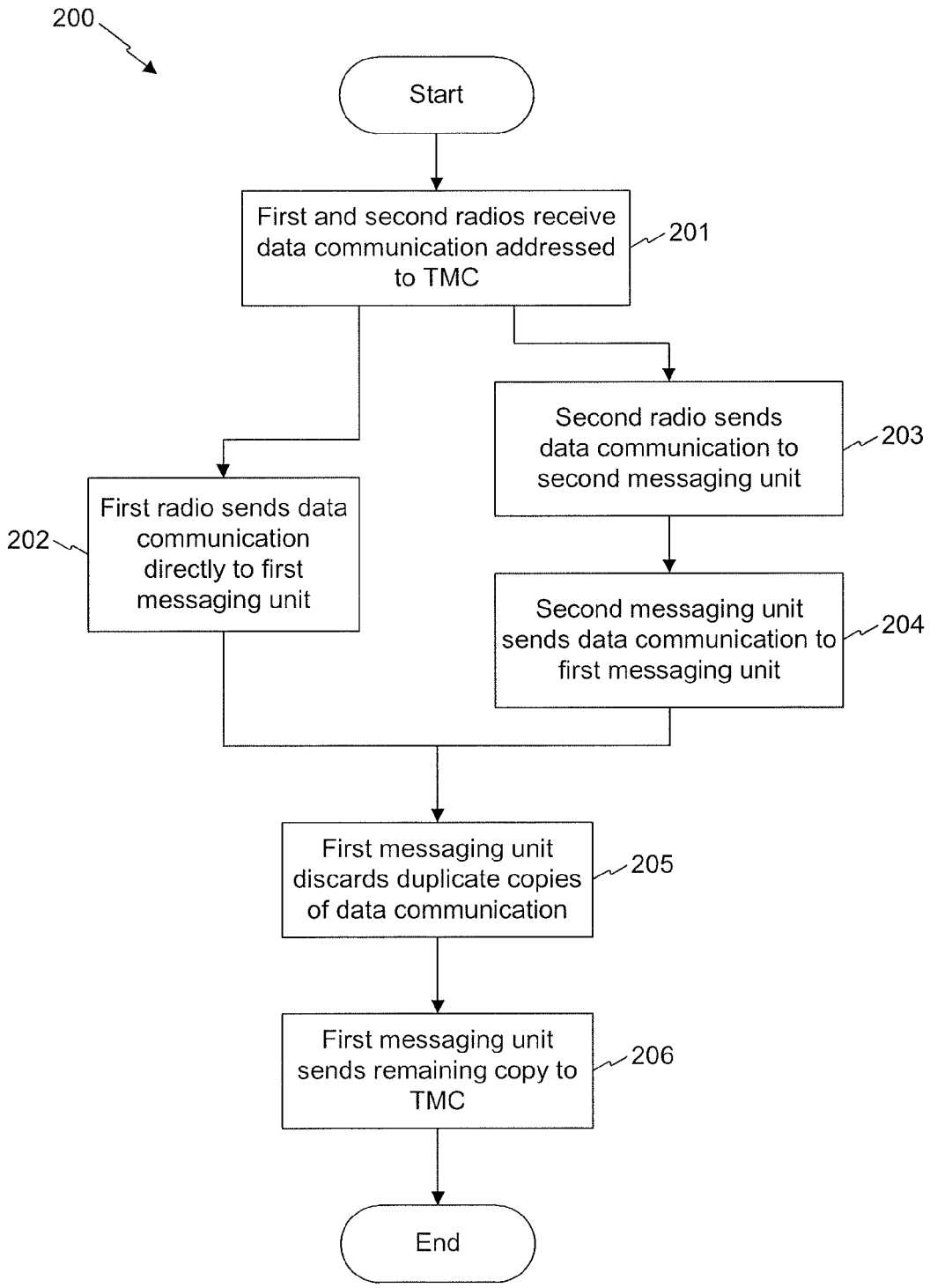
FIG. 2 depicts a flowchart of an exemplary embodiment of a process implementing a receive-efficiency application.
Figure 3:
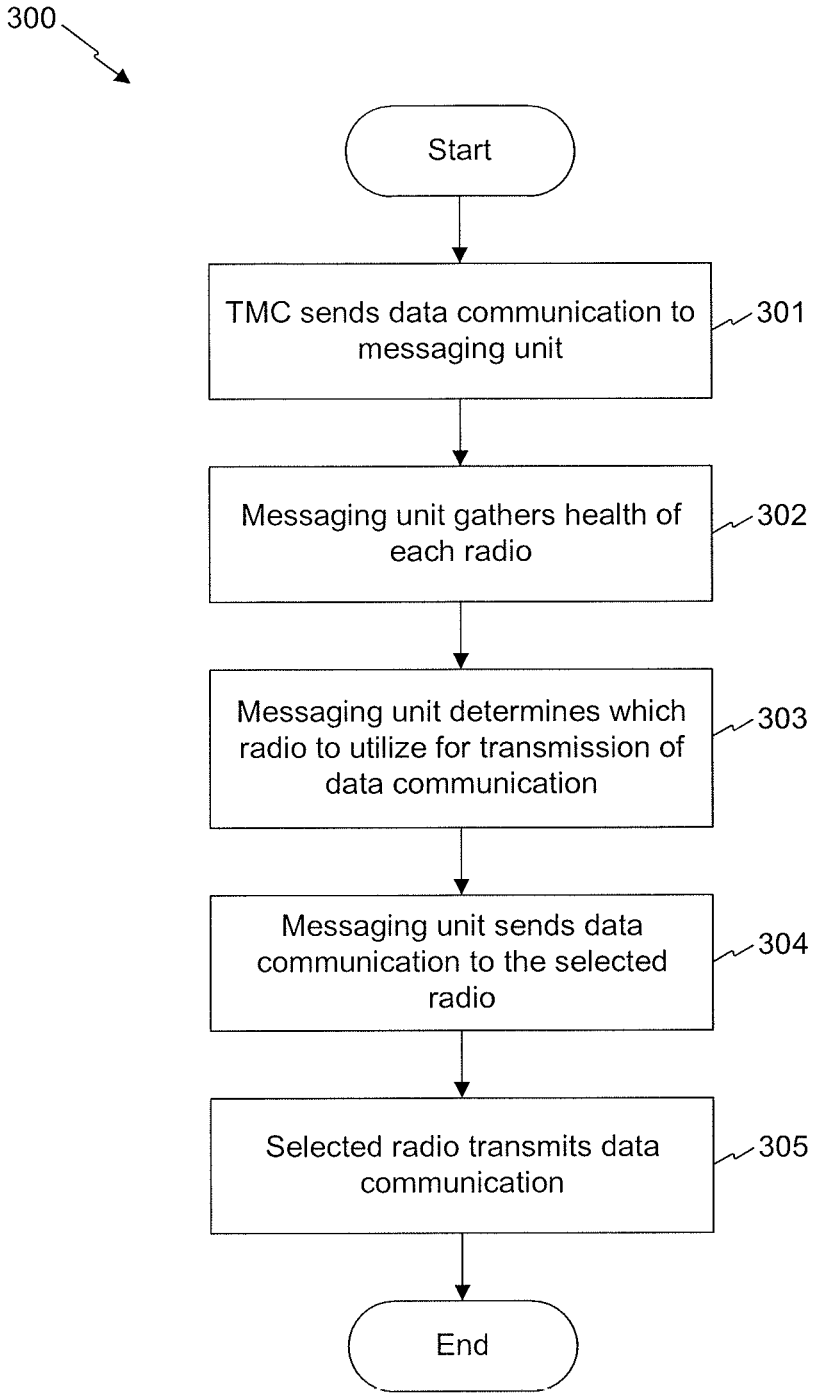
FIG. 3 depicts a flowchart of an exemplary embodiment of a process implementing a transmit-efficiency application.

The exemplary disclosed systems and methods may provide for increased reliability of automated communication systems, such as automated control system 30. The incorporation of messaging units 56, 58, 60 may create backup pathways for increasing the likelihood that messages will be delivered correctly. FIGS. 2-3 depict various processes by which messaging units 56, 58, 60 may be used in this manner.

FIG. 2 illustrates an exemplary process 200 by which messaging units 56, 58, 60 may be used in a receive-efficiency application. In one example, the receive-efficiency application may increase the likelihood that a data communication, such as an inbound message sent from a component of offboard equipment 34 (e.g., control station 44) intended to be received by a component of onboard equipment 32 (e.g., TMC 20), will be delivered successfully. Process 200 may include step 201, in which an inbound message intended for (e.g., addressed to) TMC 20 is received by each radio 36, 38, 40. For example, multiple copies of an inbound message originating from control station 44 may be sent wirelessly to rail vehicle consist 10, and may be received by each radio 36, 38, 40. The inbound message may be sent to each radio 36, 38, 40 even if it contains control instructions intended only for TMC 20 of locomotive 12.

In step 202, if receipt was successful, radio 36 may forward its copy of the inbound message to messaging unit 56. Similarly, if receipt was successful, each radio 38, 40 of locomotives 14, 16 may forward its copy of the inbound message to messaging units 58, 60, respectively, in step 203. For example, radio 38 may send its copy of the inbound message to local network 52, where it is intercepted by messaging unit 58. In step 204, messaging units 58, 60 may forward their copies of the inbound message to messaging unit 56 via intra-consist network 62. If multiple communications are successful, messaging unit 56 may receive duplicate copies of the same inbound message. In step 205, messaging unit 56 may discard the duplicate copies of the inbound message, keeping only a single copy of the inbound message. In step 206, messaging unit 56 may forward the remaining copy of the inbound message to TMC 20 to be processed.

The receive-efficiency application described in process 200 may create a diverse set of receivers through which TMC 20 (or other intended recipient) may ultimately obtain a data communication. For example, use of process 200 may increase the likelihood that TMC 20 will receive a message, as compared to a system in which radio 36 is the only receiver to which a message is sent. If radio 36 fails, it may not be capable of receiving or forwarding messages to TMC 20. However, TMC 20 may nevertheless receive the message, if one of the other radios 38, 40 successfully receives the message, since the message may he forwarded to TMC 20 through a combination of messaging units 56, 58, and/or 60 and intra-consist network 62.

FIG. 3 illustrates an exemplary process 300 by which messaging units 56, 58, 60 may be used in a transmit-efficiency application. In one example, the transmit-efficiency application may increase the likelihood that a data communication, such as an outbound message sent from a component of onboard equipment 32 (e.g., TMC 20) intended for a component of offboard equipment 34 (e.g., control station 44), will be transmitted successfully. Process 300 may include step 301, in which TMC 20 sends a data communication to messaging unit 56 for eventual transmission via one of radios 36, 38, 40. For example, TMC 20 may transmit an outbound message via network 46, which is intercepted by messaging unit 56.

Process 300 may further include step 302, in which messaging units 56, 58, 60 determine the health of radios 36, 38, 40. As used herein, health refers to the ability of a component to function as intended. In one example, health may be determined by messaging unit 56 receiving health reports from radio 36. The health reports may notify messaging unit 56 of information relevant to the status of radio 36, such as data representing whether radio 36 is functioning properly. The health reports may additionally or alternatively include statistics (e.g., receive statistics, transmit statistics, RSSI data, etc.) from radio 36 that may be stored by messaging unit 56. In this example, messaging units 58, 60 may similarly determine the health of a respectively associated radio 38, 40. Health information may be consolidated in one location, such as by messaging units 58, 60 forwarding information about radios 38, 40 to messaging unit 56 via intra-consist network 62.

In another example, the health information for each radio 36, 38, 40 may include a health value. The health value may correspond to, for example, an amount of data communications received and/or transmitted by each of the radios 36, 38, 40 over a predetermined period of time. For example, messaging unit 56 may monitor the results of a receive-efficiency application (such as process 200) to assign health values to each radio 36, 38, 40. Messaging unit 56 may maintain a total amount of successfully received messages for each of radios 36, 38, 40 for assigning health values.

In yet another example, radios 36, 38, 40 that are not to be selected for transmission may be flagged and a list of flagged radios 36, 38, 40 may be maintained by messaging unit 56. A radio 36, 38, 40, may be flagged, for example, by operator input (e.g., when an operator is aware of damage to a radio) or by a health report from a radio 36, 38, 40. In this example, the health value for each radio 36, 38, 40, may be either "healthy" or "not healthy."

In step 303, messaging unit 56 (or other messaging unit 58, 60 possessing health information for multiple radios 36, 38, 40) may determine which of radios 36, 38, 40 should be utilized to transmit the message (e.g., the message from TMC 20). Messaging unit 56 may utilize the health values to rank the relative health of each radio 36, 38, 40 and determine that the healthiest (i.e., highest-ranked) radio 36, 38, 40 (i.e., the radio determined to be most likely to successfully transmit the message) should be utilized. In another example, messaging unit 56 may determine and compare the health values of each radio 36, 38, 40 to a threshold health value. If the health value of one radio 36, 38, or 40 exceeds the threshold health value, messaging unit 56 may select that radio for transmission. If multiple radios 36, 38, 40, are determined to exceed the threshold health value, messaging unit 56 may utilize a selection algorithm, such as a random selection, a round robin selection, a position selection (e.g., always select the foremost or rearmost radio), etc., to determine which of the threshold-exceeding radios 36, 38, 40 to utilize. In the example in which unhealthy radios 36, 38, or 40 are flagged for non-use, messaging unit 56 may utilize one of these selection algorithms to select a healthy radio 36, 38, or 40 from a list of radios that are not flagged.

In step 304, messaging unit 56 may forward the outbound message to the selected radio 36, 38, or 40. For example, if radio 36 is selected for transmission, messaging unit 56 may send the outbound message directly to radio 36 via local network 46. If one of radios 38, 40 is selected, messaging unit 56 may relay the outbound message through one of messaging units 58, 60 via intra-consist network 62. In step 305, the selected radio 36, 38, or 40 may transmit the outbound message.

An alternative exemplary transmit-efficiency application may mimic the receive-efficiency application described in process 200. For example, a copy of an outbound message originating from TMC 20 may be sent to each of messaging units 56, 58, 60 via intra-consist network 62 and subsequently forwarded to each radio 36, 38, 40. Each radio 36, 38, 40 may thereafter attempt to transmit the outbound message to the intended recipient. Therefore, the likelihood of the outbound message being transmitted successfully may increase, because multiple radios 36, 38, 40 may be utilized for transmission. This alternative embodiment may achieve a combined receive-efficiency and transmit-efficiency function. In other words, messaging units 56, 58, 60 may be configured on a peer basis such that each messaging unit 56, 58, 60 sends all received inbound and outbound messages to all other messaging units 56, 58, 60.

The message management capability of messaging units 56, 58, 60 may allow for more reliable implementation of automated control system 30, since the exemplary receive-efficiency and transmit-efficiency applications may increase the likelihood that messages will be transmitted and received. This increase in reliability may translate to an increase in efficiency and safety. In addition, implementation may be cost effective because modifications to currently-existing components and installation of new equipment may be insubstantial.

It will be apparent to those skilled in the art that various modifications and variations can be made to the communication system of the present disclosure without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. An onboard communication system for a locomotive consist, comprising:

a first locomotive communication subsystem located onboard a first locomotive, including:

an onboard locomotive control system;

a first radio; and a first messaging unit communicatively connected to the onboard locomotive control system and the first radio; and a second locomotive communication subsystem, including:

a second radio; and a second messaging unit communicatively connected to the second radio and the first messaging unit, the second messaging unit being configured to:

intercept a first data communication sent from the second radio and intended for the onboard locomotive control system, and send the first data communication to the first messaging unit;

wherein the first messaging unit is configured to:

receive the first data communication from the second messaging unit;

intercept a second data communication sent from the first radio and intended for the onboard locomotive control system, wherein the second data communication is a copy of the first data communication;

determine that the first data communication and the second data communication are duplicate copies of one another; and send one of the first data communication or the second data communication to the onboard locomotive control system based on the determination, wherein the first messaging unit appears to the onboard locomotive control system as the first radio and appears to the first radio as the onboard locomotive control system.

2. The communication system of claim 1, wherein:

the first data communication is an inbound data communication, and the first messaging unit is further configured to receive a third data communication from the locomotive control system, wherein the third data communication is an outbound data communication.

3. The communication system of claim 2, wherein the first messaging unit is further configured to:

receive health information from each of the first radio and the second radio, and determine from the health information which of the first radio and the second radio is suitable for transmitting the third data communication.

4. The communication system of claim 3, wherein the first messaging unit is further configured to send the third data communication to at least one of the first radio and the second radio for transmission, wherein sending the third data communication to the second radio includes sending the third data communication through the second messaging unit.

5. The communication system of claim 3, wherein the health information includes a health value for each of the first radio and the second radio.

6. The communication system of claim 5, wherein determining which of the first radio and second radio is suitable for transmitting the third data communication includes:

comparing the health value of each of the first radio and the second radio to a threshold value, and selecting at least one of the first radio and the second radio for which the health value exceeds the threshold value.

7. The communication system of claim 5, wherein determining which of the first radio and second radio is suitable for transmitting the third data communication includes:

comparing the health value of the first radio to the health value of the second radio; and selecting the healthier of the first radio and the second radio based on the comparison.

8. The communication system of claim 1, wherein the second locomotive communication subsystem is located onboard a second locomotive.

9. The communication system of claim 8, wherein the first messaging unit is communicatively connected to the second messaging unit by a wired connection.

10. A method for managing data communication in a locomotive consist, comprising:

receiving a first data communication on a first radio on a first locomotive;

sending, by the first radio, the first data communication to a locomotive control system;

intercepting, by a first messaging unit, the first data communication intended for the locomotive control system before it is received by the locomotive control system;

receiving a second data communication on a second radio on a second locomotive, wherein the second data communication is a copy of the first data communication;

sending, by the second radio, the second data communication to the locomotive control system;

intercepting, by a second messaging unit, the second data communication intended for the locomotive control system before it is received by the locomotive control system; and sending the second data communication from the second messaging unit on the second locomotive to the first messaging unit on the first locomotive, wherein the first messaging unit appears to the locomotive control system as the first radio and appears to the first radio as the locomotive control system.

11. The method of claim 10, further including discarding one of the first data communication and the second data communication.

12. The method of claim 11, further including sending the one of the first data communication and the second data communication that was not discarded to the locomotive control system.

13. A method for managing data communication in a locomotive consist, comprising:

sending a data communication from a first locomotive control system to a first messaging unit through a wired connection;

receiving the data communication on the first messaging unit on a first locomotive;

sending health information from a first radio on the first locomotive and a second radio on a second locomotive to the first messaging unit;

determining from the health information which of the first radio and second radio is suitable for transmitting the data communication; and sending the data communication to one of the first radio and the second radio based on the determination, wherein sending the data communication to the second radio includes sending the data communication through a second messaging unit on the second locomotive, and wherein the first messaging unit appears to the first locomotive control system as the first radio and appears to the first radio as the first locomotive control system.

14. The method of claim 13, further including transmitting the data communication by the one of the first radio and second radio selected by the determination.

15. The method of claim 13, wherein sending health information includes sending a health value for each of the first radio and the second radio.

16. The method of claim 15, wherein determining which of the first radio and second radio is suitable for transmitting the data communication includes:

comparing the health value of each of the first radio and the second radio to a threshold value; and selecting at least one of the first radio and the second radio for which the health value exceeds the threshold value.

17. The method of claim 15, wherein determining which of the first radio and second radio is suitable for transmitting the data communication includes:

comparing the health value of the first radio to the health value of the second radio; and selecting the healthier of the first radio and the second radio based on the comparison.

18. The method of claim 15, wherein the health value for each of the first radio and the second radio corresponds to an amount of data communications received by each of the first radio and the second radio over a predetermined period of time.

19. The method of claim 15, wherein the health value for each of the first radio and the second radio corresponds to an amount of data communications transmitted by each of the first radio and the second radio over a predetermined period of time.

* * * * *